US009494164B2

(12) United States Patent
Baski

(10) Patent No.: US 9,494,164 B2
(45) **Date of Patent: *Nov. 15, 2016**

(54) TURBINE-PUMP SYSTEM

(71) Applicant: Henry A. Baski, Lakewood, CO (US)

(72) Inventor: Henry A. Baski, Lakewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/497,078

(22) Filed: Sep. 25, 2014

(65) Prior Publication Data

US 2015/0098793 A1 Apr. 9, 2015

Related U.S. Application Data

(60) Provisional application No. 61/888,484, filed on Oct. 8, 2013.

(51) Int. Cl.

| | |
|---|---|
| ***F04D 29/08*** | (2006.01) |
| ***E21B 43/12*** | (2006.01) |
| ***F04D 29/54*** | (2006.01) |
| ***E21B 41/00*** | (2006.01) |
| ***F04D 1/06*** | (2006.01) |
| ***F04D 13/08*** | (2006.01) |

(52) U.S. Cl.

CPC ..... *F04D 29/086* (2013.01); *E21B 41/0085* (2013.01); *E21B 43/126* (2013.01); *F04D 1/066* (2013.01); *F04D 13/08* (2013.01); *F04D 29/54* (2013.01)

(58) Field of Classification Search

CPC ..... F03B 3/10; F03B 3/103; F03B 11/006; F04D 1/06; F04D 1/14; F04D 13/021; F04D 17/12; F04D 17/122; F04D 29/044; F04D 29/086; F04D 29/54; F04D 13/08; F04D 1/066; E03B 3/06; E21B 43/126; E21B 41/0085

See application file for complete search history.

(56) References Cited

U.S. PATENT DOCUMENTS

| | | | | |
|---|---|---|---|---|
| 3,076,411 | A | 2/1963 | Guillory, Sr. | |
| 4,372,389 | A | 2/1983 | Hamrick | |
| 4,467,865 | A * | 8/1984 | Hardymon | E21B 33/1243 166/102 |
| 5,961,282 | A * | 10/1999 | Wittrisch | E21B 43/121 415/199.2 |
| 6,206,636 | B1 * | 3/2001 | Powers | F04D 29/181 415/220 |
| 7,055,595 | B2 * | 6/2006 | Mack | E21B 43/128 166/106 |
| 7,721,799 | B2 | 5/2010 | Baski | |
| 8,267,645 | B2 * | 9/2012 | Brunner | F04D 13/10 415/199.2 |
| 8,443,900 | B2 | 5/2013 | Fielder et al. | |
| 2004/0080224 | A1 | 4/2004 | Knox et al. | |

(Continued)

FOREIGN PATENT DOCUMENTS

| | | |
|---|---|---|
| JP | 08-247078 | 9/1996 |
| JP | 2012-219632 | 11/2012 |

OTHER PUBLICATIONS

Karassik, et al., The Pump Handbook, 2008, McGraw Hill, 4th Edition, ebook version, Ch. 2 Sec. 2.2.1.4 Impellers.*

(Continued)

*Primary Examiner* — Dwayne J White
*Assistant Examiner* — Adam W Brown
(74) *Attorney, Agent, or Firm* — Stephen A. Gratton

(57) ABSTRACT

A turbine-pump system adapted for use with well liquid that is displaceable within a well conduit. The turbine-pump system may include a bowl assembly; and a bowl support device fixedly attachable to the bowl assembly and selectively engageable with the well conduit for holding a portion of the bowl assembly in substantially axially, radially and rotationally fixed relationship with the well conduit.

17 Claims, 6 Drawing Sheets

(56) References Cited

U.S. PATENT DOCUMENTS

| | | | |
|---|---|---|---|
| 2012/0213632 | A1 | 8/2012 | Parry et al. |
| 2015/0098794 | A1 | 4/2015 | Baski |

OTHER PUBLICATIONS

PCT International Search Report dated Jan. 19, 2015, 1 page.
English Abstract of JP 08-247078, 2 pages.
English Abstract of JP 2012-219632, 1 page.
Office Action in U.S. Appl. No. 14/497,106, filed Sep. 25, 2015, mailing date Aug. 31, 2015, pp. 1-15.
Office Action in U.S. Appl. No. 14/497,106, filed Sep. 25, 2015, mailing date Dec. 11, 2015, pp. 1-21.
Igor J. Karassik et al., Pump Handbook Fourth Edition, Dec. 18, 2007,pp. 1-6, McGraw Hill, New York, NY.

* cited by examiner

TURBINE-PUMP SYSTEM

This application claims priority of U.S. Provisional Patent Application No. 61/888,484, filed Oct. 8, 2013, which is hereby incorporated by reference for all that it discloses.

This application also hereby incorporates by reference for all that it discloses, a related application Ser. No. 14/497,106 filed Sep. 25, 2014, entitled TURBINE PUMP SYSTEM BOWL ASSEMBLY having the same inventor and filing date as the present application.

BACKGROUND

There are many known pumping systems for raising well water or other liquids to the surface. However, raising liquids from deep wells presents problems that have not been adequately addressed by existing pump technology. Currently available electrical turbine pumps and electric submersible pumps have severe horsepower and pumping head and temperature limitations.

There are many applications for deep well pumping systems today. One such application is mine dewatering. Mine Dewatering depths range from 1,000 to 7,000 feet below ground surface. Capital costs for conventional deep well mine pumps are typically on the order of 1-10 million dollars per mine.

Another deep well pumping application is for water supplies. Water supplies include domestic drinking water for cities and large-scale irrigation projects. Water supply aquifer depths can be 3,000 ft. or deeper. Pumping hot water from geothermal deposits for energy production is another application for deep well pumps. Oil and gas wells used in tight shale reserves require large volumes of ground water that must often be pumped from deep wells. Petroleum pumping, including off shore petroleum pumping is another application for deep well pumps.

Some large scale, renewable energy storage systems are based on pumped water storage using vertical turbine-pumps. Vertical turbine-pumps are driven by an electric motor during pumping operations. Such turbine-pumps can also be operated in a reverse direction with injected water causing rotation of a drive shaft that causes rotation of a motor armature in an opposite direction such that the motor functions as an electrical generator. Renewable energy storage systems have a deep aquifer, which functions as a lower reservoir, and a shallower aquifer or a surface level reservoir, which functions as an upper reservoir. During periods of excess wind energy production, water is pumped from the lower reservoir to the upper reservoir. During periods of low wind production, water is released from the upper reservoir and injected into the lower reservoir. During this water injection the vertical turbine-pump functions as a power generator turbine.

The above are just a few of the many applications for deep well pump systems and vertical turbine-pump systems. However currently, deep well pump systems are extremely expensive to make and install, difficult and expensive to maintain, inefficient and unreliable. Thus, there is a great need today for reliable, efficient, relatively low maintenance and reasonably priced deep well turbine-pump systems.

SUMMARY

This specification discloses example embodiments of a well liquid turbine-pump system. The turbine-pump system may include a hollow driveshaft that is adapted to be rotatably positioned inside a well casing. In some embodiments, the turbine-pump system has a surface mounted driver that is adapted to rotate the hollow driveshaft. Some embodiments of the system include impeller members adapted to rotate with the hollow driveshaft. The impeller members may be positioned within associated diffuser members that are adapted to form a well liquid channeling enclosure around the impeller members. In some embodiments several impeller members are connected together in a continuous impeller subassembly that is positioned within a continuous diffuser subassembly.

Some embodiments of the turbine-pump system include at least one inflatable packer assembly that is sealingly engageable with a diffuser subassembly and the well casing. The inflatable packer member is adapted to hold the diffuser subassembly in relatively axially and radially fixed relationship with the well casing. In some embodiments a bowl assembly, comprising a series of continuously connected diffuser members, is supported by a single inflatable packer assembly. The seal between the bowl assembly and the well casing that is formed by the packer assembly, prevents well liquid from flowing around the bowl assembly instead of through the bowl assembly.

In some embodiments of the turbine-pump system, the hollow driveshaft has a working fluid passage extending axially through it. Bearings supporting the hollow drive shaft may be lubricated with working fluid transmitted through the hollow driveshaft. Inflatable packer assemblies supporting the bowl assemblies may be inflated with working fluid transmitted through the hollow driveshaft.

Some embodiments of the liquid turbine-pump system may provide one or more of the below described advantages.

Inflatable packer assemblies may be used that counteract the torque of the driveshaft and the weight of the drive shaft and other components. Such packer assemblies (sometimes referred to herein simply as "packers") may support separate, axially spaced sections of the turbine-pump system, which may be modular components of the turbine-pump system.

The use of a hollow driveshaft facilitates packer inflation and bearing lubrication with working fluid pumped through the hollow driveshaft. The hollow driveshaft can withstand more torque than a solid driveshaft of the same weight, enabling use of larger, higher torque, surface mounted drive motors that may be operated at lower speeds than traditional pump motors for the same throughput. The use of larger drive motors allows much greater pumping rates than traditional deep well pumps. Also, threaded connection portions of each of the impeller members are provided with a relatively larger cross-sectional area than traditional impeller members because the diameter of the hollow driveshaft is proportionally larger than that of a conventional solid driveshaft of the same weight. The larger cross-sectional area of applicant's impeller members can withstand higher torque and vertical loading than the smaller impeller cross-sectional area associated with the use of a solid drive shaft.

The hollow driveshaft in some embodiments may be constructed from lengths of oil field drill pipe. Such oil field drill pipes are relatively easy to connect and disconnect compared to connecting and disconnecting large diameter pump columns used for conventional vertical centrifugal pump systems.

In the new turbine-pump system described herein, there is no well column positioned inside a well casing as there is in the prior art. The well column (column pipe) is eliminated. and the well casing itself is the primary conduit for transmitting well liquid. Thus, one heavy and expensive component of a turbine-pump system is eliminated in applicant's new turbine-pump system. The relatively larger internal diameter of a well casing provides for more efficient liquid flow within the well, since larger diameter conduits have inherently lower energy loss due to friction than smaller diameter conduits.

Applicant's use of inflatable packers and a hollow driveshaft in some embodiments facilitates the modular construction of bowl assemblies. Such modular construction may provide a number of advantages. The bowl assembly modules may all have identical construction, which may reduce manufacturing costs and help to standardize installation procedures. The modules are each individually supported by an associated packer, reducing the load that any single packer must support. Each packer supported bowl assembly module supports an associated length of hollow driveshaft and an impeller subassembly. Because the total weight of all the down-hole components of the system are distributed over separately supported modular units, the total length of the line shaft is essentially unlimited by weight considerations, enabling the system to pump from well depths of 10,000 ft. or more.

Modular construction makes it relatively easy to add length to the turbine-pump system, as required by falling liquid surface levels in the associated well.

The connection or disconnection of down-hole sections of applicant's turbine-pump system involves connecting and/or disconnecting sections of a hollow driveshaft. It does not require connection of heavy and unwieldy sections of a conventional pump column. The hollow driveshaft in some embodiments is constructed from lengths of oil field drill pipe, which are relatively easy to connect and disconnect compared to connecting and/or disconnecting large diameter pump columns and associated shafting for vertical turbine pumps or electric power cable for electric submersible pumps.

The use of a continuous impeller subassembly and a continuous diffuser subassembly in each bowl assembly enables the entire series of bowl assemblies to be rotated by a single surface driver. It also enables the use of a semi-open impeller blade and diffuser vane design with associated improved efficiency in parts fabrication and more efficient pump operation. Internal bypass or leakage within the bowl assembly is eliminated.

DETAILED DESCRIPTION

As used herein, the term "turbine-pump" refers to turbines and to pumps and to apparatus, such as the electric submersible vertical turbine-pumps described in the Background, that may function in both turbine and pump operating modes. Thus, an apparatus referred to as a "turbine-pump" may be an apparatus that functions only as a turbine or an apparatus that functions only as a pump or an apparatus that functions as both a turbine and a pump.

Figure 1:
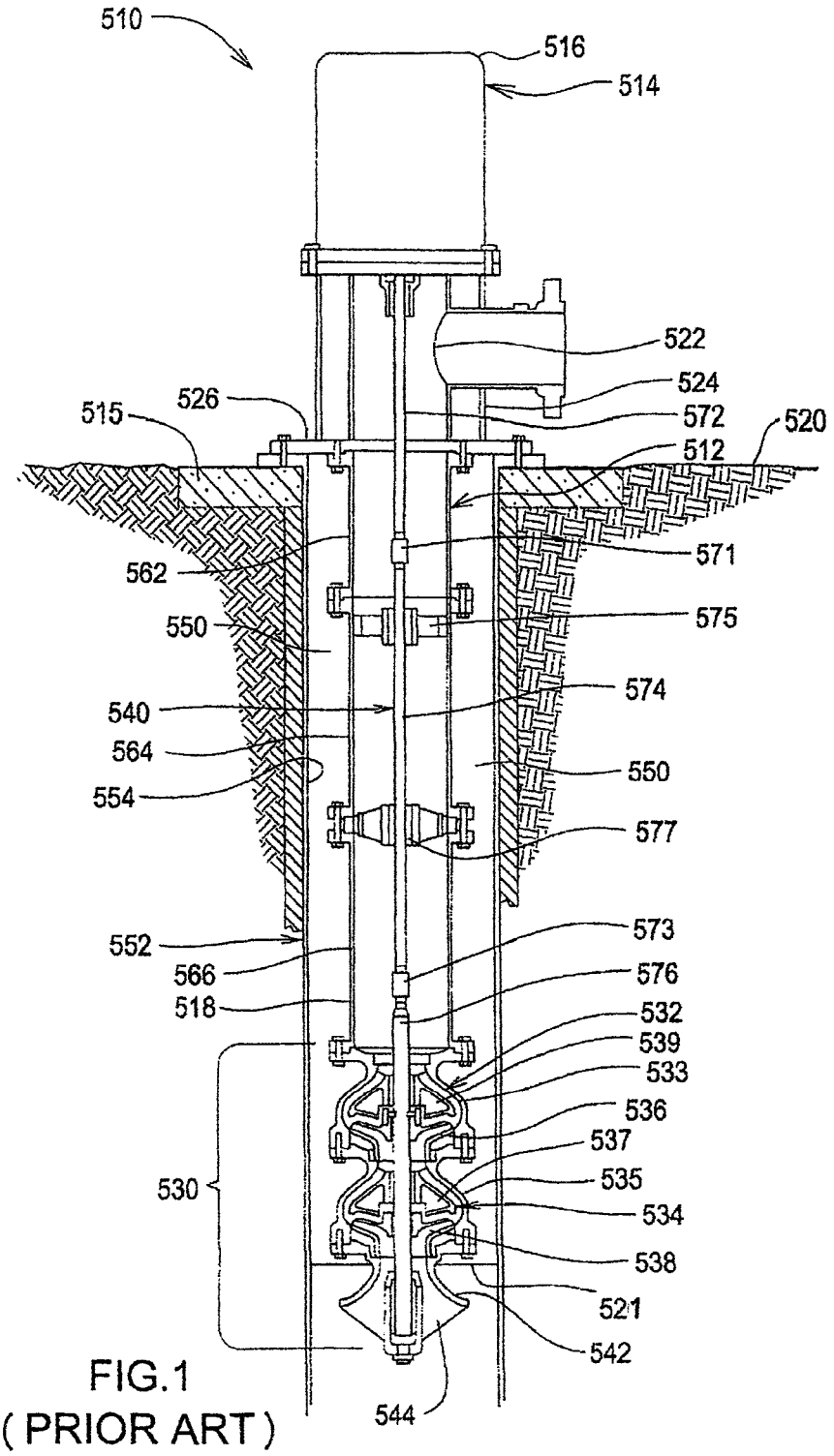
FIG.1 ( PRIOR ART )
FIG. 1 is a schematic cross-sectional elevation view of a prior art vertical pump system.

As illustrated by FIG. 1, a well from which water is to be pumped by a conventional vertical turbine-pump assembly 510 comprises a cylindrical vertical well enclosure 550. The vertical well enclosure 550, is defined by an inner wall surface 554 of a tubular well casing 552. The well casing 552 may be conventionally assembled in an excavated vertical well hole/shaft. The vertical turbine-pump assembly 510 includes a tubular well column (sometimes referred to in the art as a "column pipe") 512 that is positioned in the vertical enclosure 550, i.e., inside the tubular well casing 552. An electric pump motor/generator 514 is mounted at a position 516 above the well column 512. The well column 512 is in fluid communication with a bowl assembly 530 attached to the lower end 518 of the well column 512. The well column 512 is typically made of a high strength metal such as cast iron or steel.

The bowl assembly 530 usually includes one or two bowl members, sometimes referred to in the art as bowl stages, 532, 534. Each bowl member 532, 534 comprises a hollow diffuser member 533, 535. The diffuser members each have vanes projecting inwardly from an outer shell/housing portion. Each bowl member 532, 534 also comprises an impeller member 536, 538, having one or more rotating blades. Each impeller member 536, 538 is rotatable relative to the associated diffuser member 533, 535 by a solid driveshaft 540. The driveshaft 540 extends through the bowl assembly 530 and tubular well column 512 and is operable attached to the turbine-pump motor 514 at the top of the well column 512.

The turbine-pump motor/generator 514 is typically positioned above ground level 520. A bowl skirt 542 generally forms the lower end of the bowl assembly 530 and is positioned below the water level 521 in the vertical well enclosure 550. Well water enters the bowl assembly 530 through an opening 544 in the bowl skirt 542. The well column 512 is attached in sealed relationship with the bowl assembly 530 and has a bottom opening in fluid communication with an upper opening of the bowl assembly 530.

Rotation of the driveshaft 540 rotates the attached impellers 532, 534 causing water to be raised up through the bowl assembly 530 and through the attached well column 512. The stationary diffusers members 533, 535 operate in cooperation with the rotating impeller members 536, 538 to create an upward flow of water through the bowl assembly 530 and well column 512. Well water is typically pumped through an opening 522 at the upper end 524 of the well column 512 and into a horizontally disposed pipeline. The pipeline may ultimately discharges into a water reservoir (not shown) located on or near the surface 520.

The pump column 512 may be vertically supported near its upper end 524 by an annular fixed plate 526, or the like, which may in turn be attached to a concrete pad (not shown) located near the top of the well casing 552. Thus, the pump column 512 remains stationary as the driveshaft 540 rotates within it. The pump column 512 may comprise a number of axial sections 562, 564, 566 that are bolted together or otherwise connected. The driveshaft 540 may also comprise a plurality of axial sections 572, 574, 576 attached by couplings 571, 573. Bearing assemblies 575, 577, attached to the well column 512, may be used to support the driveshaft 540 radially and axially.

When the water level 521 in the well falls below the level of the bowl assembly skirt 542, additional axial sections must be added to the well column and additional axial sections must be added to the driveshaft. With major water level declines, this involves pulling the entire pump column 512 and the entire drive shaft 540 out of the well casing 552.

The bowl assembly is then removed from the pump column and a new section of pump column is attached between the existing lower end of the pump column and the bowl assembly 530. A similar operation is performed to install a new section to the drive shaft 540 between the existing end thereof and the portion of the drive shaft in the bowl assembly 330. The pump column 552 is extremely heavy and thus requires an expensive heavy crane or the like for the removal and reinsertion operation.

In applications of the vertical turbine-pump 510, water from a surface reservoir (not shown) may be injected through inlet 522 causing the drive shaft of the vertical turbine-pump assembly 510 to rotate in a direction opposite to the direction of rotation when the assembly 510 functions as a pump. Thus, during water injection the turbine-pump assembly 510 rotates the electric motor thereof in an opposite direction to produce electricity, which may be conventionally transferred to an electrical grid.

Figure 2A:
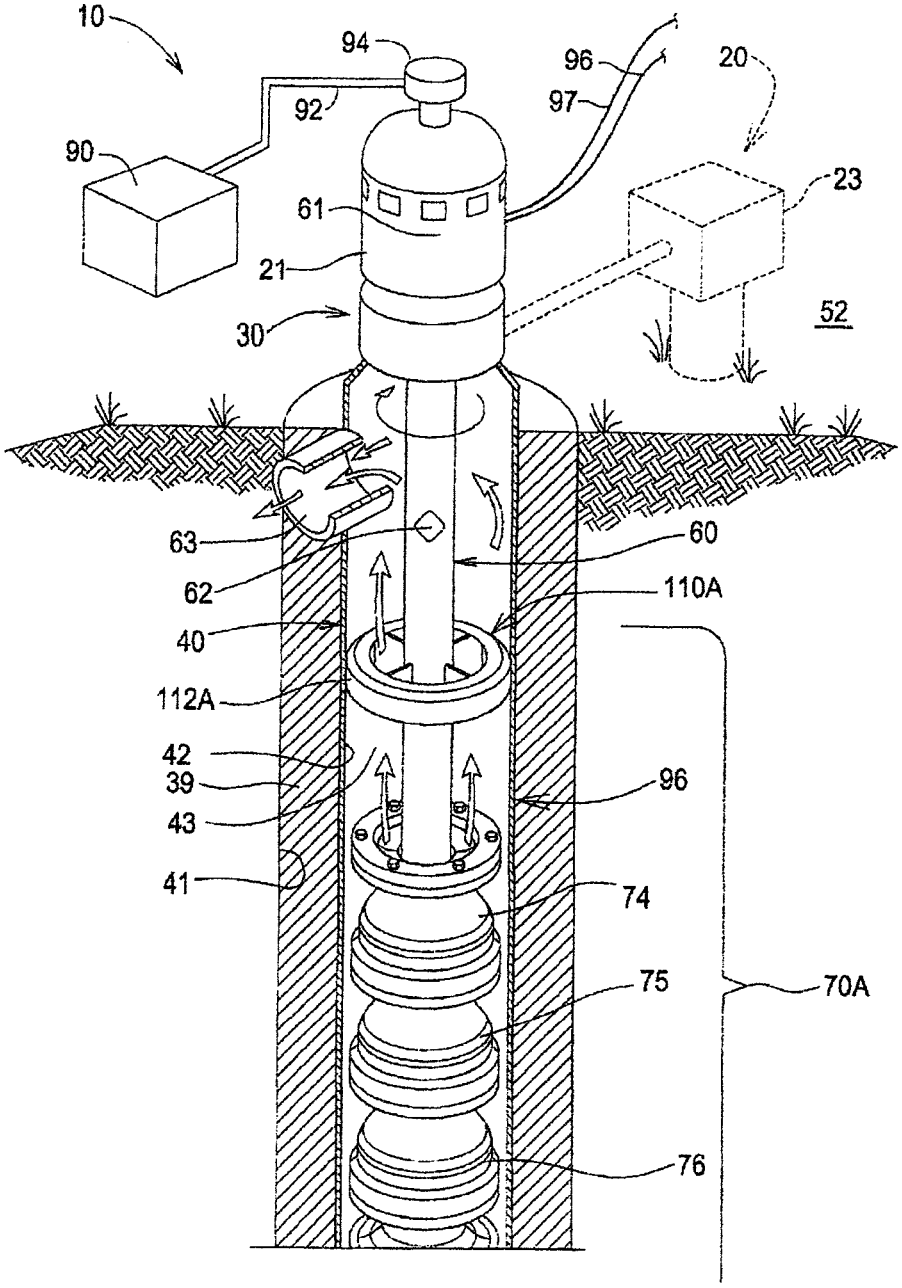
FIGS. 2A and 2B are schematic, partially cross-sectional isometric views of upper and lower portions of an example embodiment a centrifugal turbine-pump system.
Figure 2B:
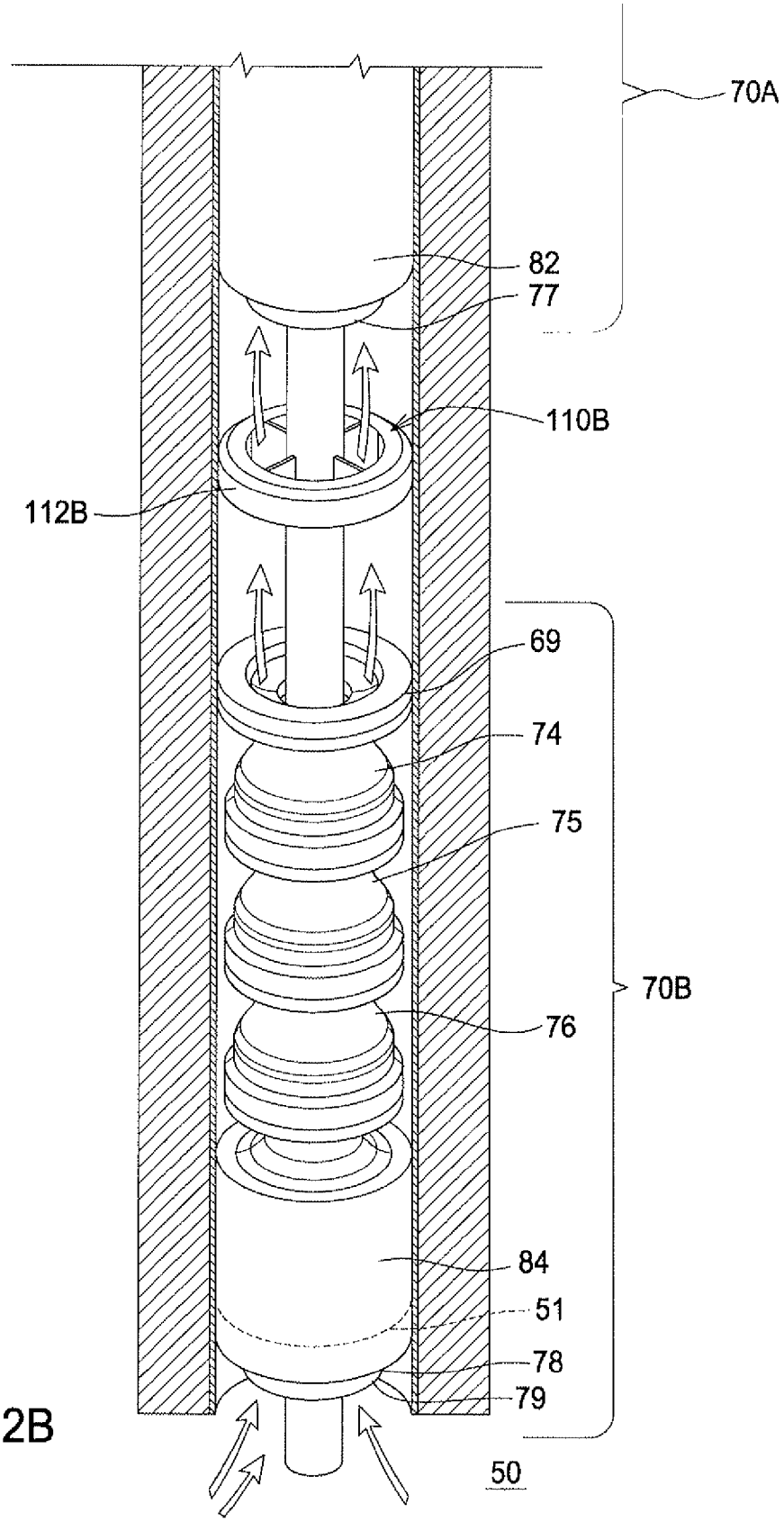

FIGS. 2A and 2B schematically illustrate a turbine-pump system 10 that includes a driver 20 that may be located at ground level 52 to provide a reliable and readily accessible power supply. The driver 20 may be, for example, a vertical shaft electric motor 21 (that may be operated in a reverse direction as a generator) or a right angle drive unit 23 (shown in dashed lines), that may be an engine, turbine, or other drive means. If a turbine is used for drive unit 23 is used it could be a steam powered turbine or a combustion turbine. Such drive sources are capable of producing a high power output (e.g. 10,000 hp. or more), which is needed for high volume pumping of water from extremely deep, e.g., 10,000 ft., wells. Large load-bearing axial thrust bearings 30, which may be positioned above ground level 52, connect the motor assembly 20 to a hollow driveshaft 60, as described in further detail below.

Existing or new well casing 40, which in some embodiments is about 6 in. to 36 in. in internal diameter, extends axially along an excavated well shaft 41. In some embodiments there is a space between the surface of excavated well shaft 41 and the outer surface of the well casing which is backfilled or filled with other material 39. (Well casing and the manner in which it is installed in a well excavation are known in the art and are thus not further described herein.) The well casing 40 defines a cylindrical well enclosure 43 through which water 50 at the bottom of the well is pumped to the surface 52. Use of the well casing 40 as the conduit for transmitting water eliminates the need for an expensive, heavy well column of the type described above with reference to prior art well column 512. The larger cross section of a well casing cavity compared to that of a well column (column pipe) facilitates efficient, relatively low friction water flow, as compared to the water flow through a well casing with a smaller cross section. Portions of the turbine-pump system 10 are supported and stabilized by inflatable packers 82, 84 that engage an interior wall surface 42 of the well casing 40, as described in further detail below.

A hollow mechanical driveshaft 60 transfers mechanical energy from the driver 20 to multiple impeller members (e.g. 370, 380, FIG. 3A, not shown in FIGS. 2A and 2B) within each of a plurality of "bowl assemblies," e.g., 70A, 70B, FIGS. 2A and 2B. A "bowl assembly," e.g. 70A, includes a "diffuser subassembly" and a corresponding "impeller subassembly," as well as other components. As used herein, a "diffuser member" refers to a separate, stationary structure that operates in combination with a rotating "impeller member" to create water flow through the turbine-pump system 10.

Each diffuser member 74, 75, 76, typically has an impeller member, (e.g., 370 in FIG. 3A, not shown in FIGS. 2A and 2B) operatively associated with it. The diffuser member is positioned in axially and radially fixed relationship within the well casing 40. The drive shaft 60 extends through each diffuser member 74, 75, 76. An impeller member associated with a diffuser member is fixedly attached to the driveshaft 60 and rotates with the driveshaft 60. The associated diffuser member does not rotate with the drive shaft 60. In other words, the driveshaft 60 and impeller member 370 FIG. 3A) attached thereto rotate inside an associated fixed diffuser member 74, 75, 76.

The driveshaft 60 is constructed of a size and strength sufficient to handle the torque and axial loading created by the associated turbine-pump system 10. The driveshaft 60 may be a customized oil field shouldered drill pipe construction. An axial internal passageway 62 (sometimes referred to herein as "working fluid passage 62" or simply "passage 62") of the hollow driveshaft 60 enables the flow of working fluid used for inflating down-hole packers 82, 84 that form a part of each bowl assembly 70A, 70B. The passage 62 also enables this same working fluid to be provided to bearings (not shown in FIGS. 2A and 2B) that are positioned along the hollow driveshaft 60. The hollow driveshaft 60 has an upper end portion 61 coupled to the driver 20. The working fluid used to inflate the packers 80 and lubricate the bearings (not shown in FIGS. 2A and 2B) may be water or oil or a water and oil mixture or other liquid, which is stored in a pressurized liquid supply (not shown) and pumped with pump 90 through a small conduit 92 and a rotary union 94 into the hollow driveshaft passage 62. The internal passageway 62 is sealed at the lowermost end of the hollow driveshaft 60, enabling the working fluid to be pressurized.

The hollow driveshaft 60 because of its relatively large annular cross-section may withstand higher torques than a solid driveshaft with the same mass. Use of a high torque driveshaft enables the use of high torque impellers that may be operated at lower rotational speeds to produce the same water flow as high speed/low torque impellers. It also enables the use of very large, high power drive units that would destroy a solid shaft of the same mass. The hollow driveshaft 60 also enables a modular construction in which each module comprises a bowl assembly. Each bowl assembly may comprise a diffuser subassembly, an impeller subassembly that is rotated by an associated portion of hollow drive shaft and a packer assembly. The hollow drive shaft 60 may comprise separate lengths of drill pipe, which may have standard threaded ends and which may thus be quickly and easily connected by standard drill pipe connections. The driveshaft/diffuser member/impeller member mounting arrangement is described in detail with reference to FIGS. 3A and 3B below. The external and internal diameters of the drive shaft 60 will be determined by the torque that it must withstand, the size of internal passage needed for transmitting working fluid, etc.

The bowl assemblies 70A, 70B may be spaced throughout the axial length of the casing 40 at intervals. In some embodiments the spacing intervals are between about 200 ft. and 500 ft. (It will be understood that FIGS. 2A and 2B are schematic and that many such bowl/diffuser assemblies may be required depending upon the depth of the well.) Each bowl assembly, e.g., 70A is held in sealed, fixed relationship with an associated length of well casing by a packer, e.g., 84 that forms a portion of the bowl assembly.

Well water 50 is drawn in through an inlet portion opening 79 of conduit or sleeve 78 that forms the bottom end of the lower most bowl assembly 70B. The inlet opening 79 is positioned below the surface level of the well water 50. The rotation of impeller members (described in detail below with reference to FIGS. 3A and 3B) in the lower assembly 70B raises the water through each diffuser member, 76, 75, 74 and out the discharge end 69 of the bowl assembly 70B. Then the water moves through a portion of the casing enclosure 43 to the next bowl assembly 70A. All of the water that eventually reaches the surface flows through each bowl assembly 70A, 70B because the associated packer, e.g. 84, seals off the annular region between the bowl assembly 70B and the casing 40, thus preventing water from flowing around the associated bowl assembly. The water is progressively lifted in this manner from one bowl assembly 70B to the next bowl assembly 70A to the upper portion of the well casing 40 where it may be discharged through conduit 63 at or near the surface 52.

The description immediately above is a description of operation of the turbine-pump system 10 in a pump operating mode. In a turbine operating mode of the system 10, water from a surface reservoir or other source (not shown) is injected into the well casing through conduit 63. The water flows downwardly through the well casing and each bowl assembly, causing the impeller subassemblies in each bowl assembly to rotate in a reverse direction from that when the system 10 is in the pump operating mode. In the turbine operating mode the rotation of the impellers by the descending water flow provides torque to the hollow drive shaft 60 that is transmitted to the motor/generator 21 attached thereto. The motor/generator 21 is thus rotated in a generator mode to produce electricity, which may be transferred by electric cables 96 to a connected electric grid (not shown).

The use of multiple bowl assemblies allows for reasonable pressure differentials across each bowl assembly 70A, 70B. In conventional As mentioned above, each bowl assembly 70A, 70B in the illustrate embodiment of FIGS. 2A and 2B has the lower end thereof held and sealed against the well casing 40 by an associated bowl assembly end packer, e.g., 84. Each of these bowl assembly end packers 82, 84 has an internal conduit member, e.g. 78 that is connected in fluid communication with a lower end of a lower diffuser member, e.g. 76 in each bowl assembly, e.g., 70B. In another embodiment, not shown, the end packers 82, 84 are positioned at the upper ends of the associated bowl assemblies 70A, 70B, rather than at the lower ends.

The frictional engagement of the bowl assembly end packers 82, 84 with the well casing surface 42 vertically supports the associated bowl assembly 70A or 70B, etc., and prevents the associated diffuser subassembly 70A or 70B from rotating. Diffuser packers 82, 84, etc., also seal off the annular space between each bowl assembly 70A, 70B and the inside surface 42 of the well casing 40. Thus, water flows through the diffuser assemblies rather than around them. Conventional bearings (e.g. 392 and 358 shown in FIGS. 3A and 3B) within each bowl assembly 70A, 70B support the hollow driveshaft 60 and enable it to resist radial and axial forces. The radial and axial forces generated at each set of bearings are relatively low because of the multiple driveshaft support bearings that are provided, i.e. one or more axial and radial bearing assembly may be provided for each bowl assembly packer 82, 84.

Depending upon the distance between bowl assemblies 70A, 70B and the stiffness of the driveshaft 60, intermediate bearing assemblies 110A and 1108, held in position by intermediate packers 112A and 112B may be used to provide additional support to the driveshaft 60.

In another embodiment, each bowl assembly 70A, 70B, etc. has few fewer individual diffuser members 74, 75, 76 and the bowl assemblies 70A, 70B, etc., are spaced more closely, for example 60 to 120 ft. apart. In such an arrangement no intermediate bearing assemblies may be needed. The bowl assemblies 70A, 70B described above with reference to FIGS. 2A and 2B may have the same construction as the bowl assemblies used in the centrifugal pump 200 of FIG. 3B, described below, except that in FIGS. 3A and 3B, each bowl assembly has two rather than three diffuser members.

Figure 3A:
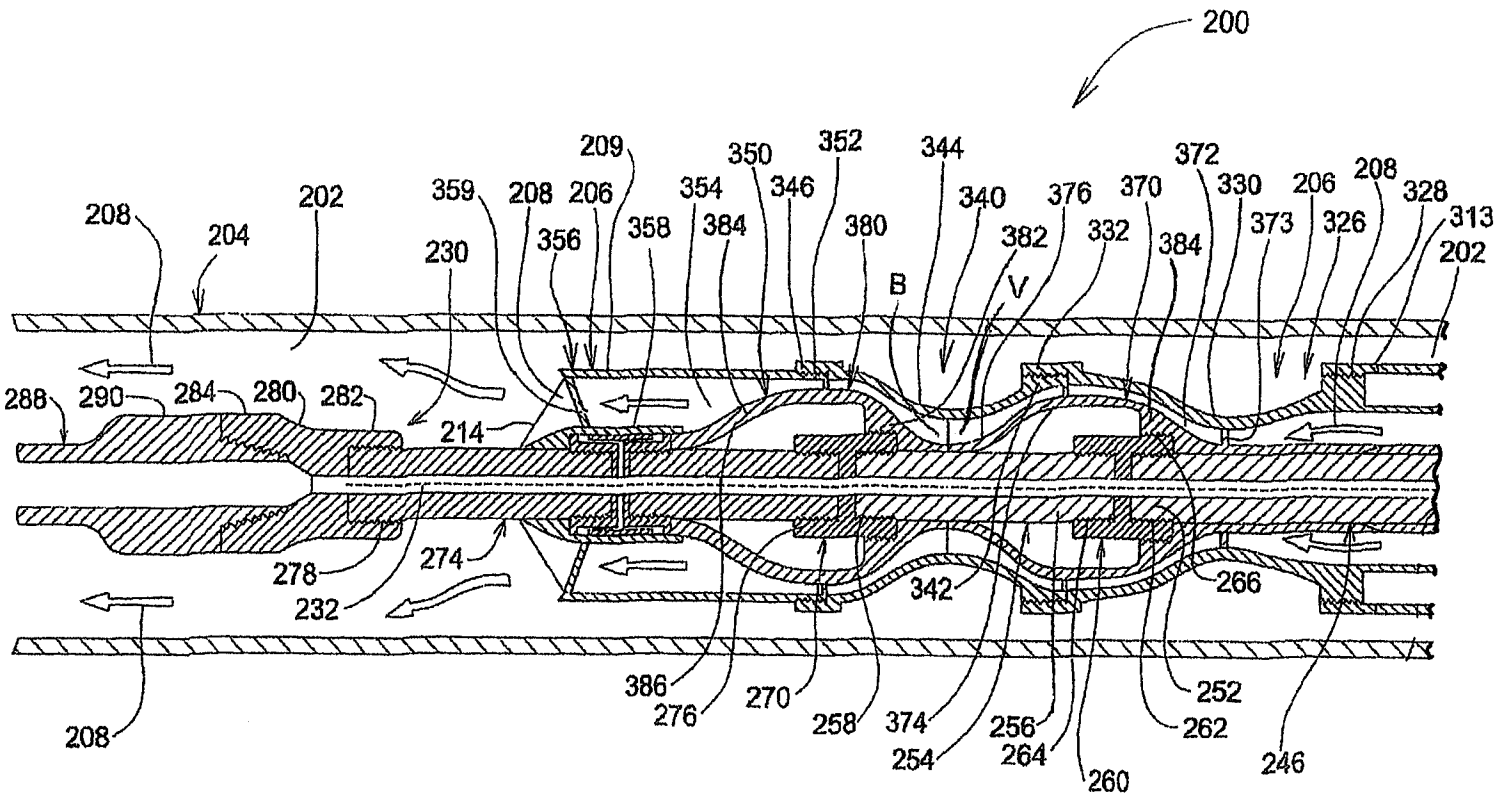
FIGS. 3A and 3B are schematic cross-sectional views of a portion of an example embodiment of a bowl assembly for a centrifugal turbine-pump system.
Figure 3B:
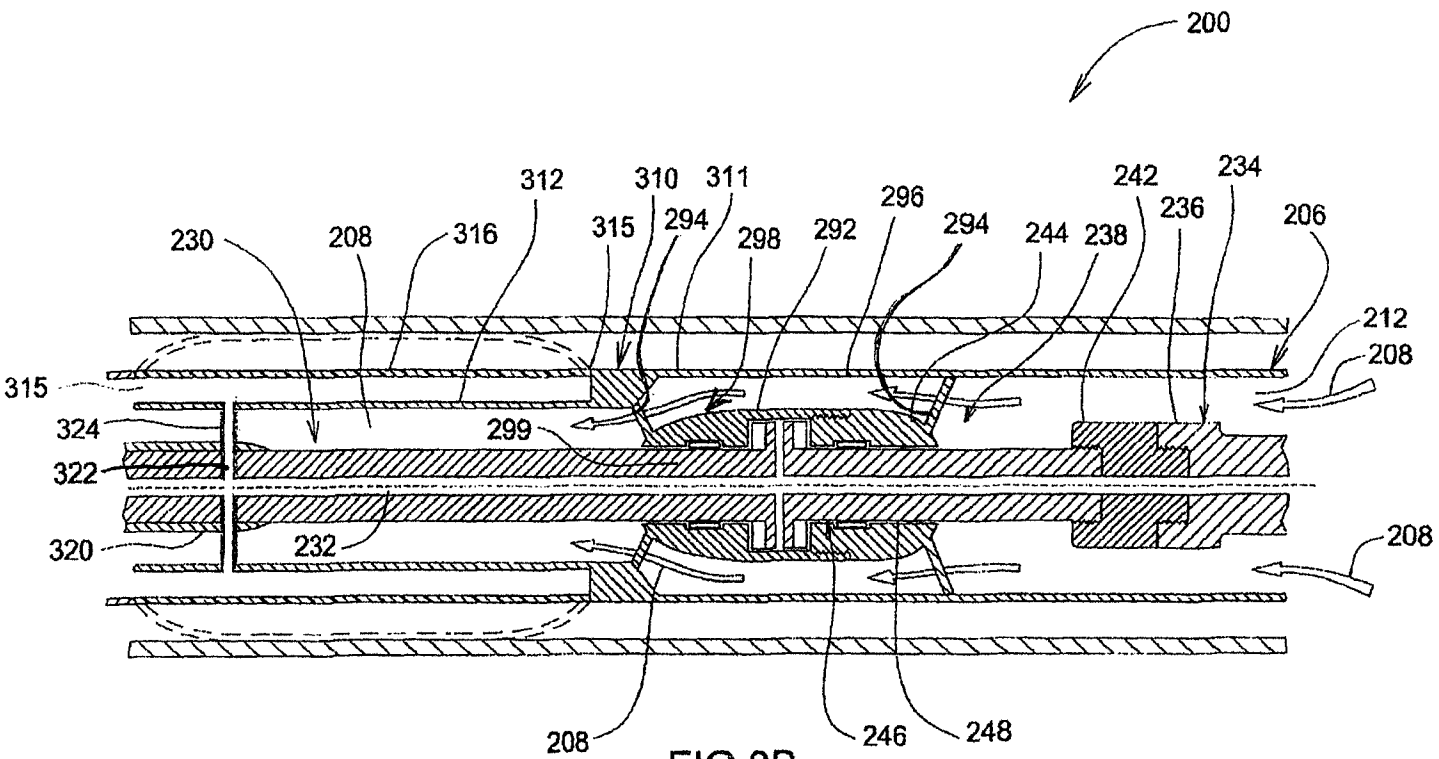

FIGS. 3A and 3B show a centrifugal turbine-pump 200 positioned in a vertical cylindrical space 202 defined by a conduit such as a well casing 204. A bowl assembly 206 defines a portion of a water flow path 208 through the vertical cylindrical space 202. The bowl assembly 206 has an inlet sleeve portion 296 providing a water inlet 212 at its lower end. The bowl assembly 206 has an outlet sleeve 209 defining a water flow outlet portion 214.

An elongate hollow driveshaft assembly 230 extends longitudinally through a center portion of the bowl assembly 206. The hollow driveshaft assembly 230 defines a continuous working fluid passage 232, which extends through the entire length of the driveshaft assembly 230 and is closed at the bottom end thereof (not shown).

The hollow driveshaft assembly 230 is a rotating portion of the bowl assembly 206. The driveshaft assembly 230 includes a first externally extending conduit, which in one embodiment is a conventional oil well drill pipe 234. The drill pipe 234 may have an expanded threaded end portion 236. An inlet coupling member 238 may have threaded end portions 242, 244. The coupling member 238 connects the external drill pipe 234 to a first internal hollow drive shaft length 246 at a first threaded end portion 248 thereof. The first internal hollow drive shaft length 246 has a threaded second end portion 252, FIG. 3A, positioned in alignment with a second internal hollow drive shaft length 254 that has a first threaded end portion 256 and a second threaded and portion 258. A threaded coupling member 260 has internal threads 262 at a first end thereof and internal threads 264 at a second end thereof, which connect the first and second internal hollow drive shaft lengths 246, 254. The threaded coupling member 260 also has external threads 266, used to attach an impeller member, as described in further detail below. Another coupling member 270 that may be of identical construction to the threaded coupling member 260, is attached to the second threaded end portion 258 of the second internal hollow drive shaft length 254 at a first threaded end portion 256 thereof. A third internal hollow drive shaft length 274 having a first threaded end portion 276 and a second threaded end portion 278 is attached to the second internal hollow drive shaft length 254 by the coupling member 270. The second threaded end 278 of the third internal hollow drive shaft length 274 projects outwardly from an outlet sleeve portion of the bowl assembly 206. An outlet end coupling member 280 having a first threaded end portion 282 and a second threaded end portion 284 attaches the third internal hollow drive shaft length 274 to an upper end external drill pipe 288, which may have an expanded threaded end portion 290. Thus the hollow driveshaft assembly 230 that forms a portion of the bowl assembly 206 in the illustrated embodiment of FIGS. 3A and 3B includes multiple pipe portions and annular coupling members that define a fluid passageway for working fluid that extends from one end of the bowl assembly 200 to the other.

An annular axial and radial thrust bearing assembly 292 may be mounted on a lower end portion of the first internal hollow drive shaft length 246. The annular bearing assembly 292 supports the hollow driveshaft assembly 230 both axially and radially while enabling rotation of the driveshaft 230 assembly relative to a diffuser subassembly of the bowl assembly 206. The annular bearing assembly 292 is attached, as by struts 294 to an annular lower sleeve portion 296 of the elongate housing 206. Annular bearing assembly 292 comprises a rotary fluid seal assembly 298. The Rotary fluid seal assembly 298 maintains a sealed, controlled leakage relationship with the outer surface of drill pipe 246 while enabling rotational movement of the drill pipe 246 within the seal assembly 298. Working fluid in the internal passage 232, passes through radially extending bores 299 to an annular reservoir (not shown) of the annular seal assembly 292. The working fluid is transmitted through this annular reservoir in the fluid seal assembly 298 to the annular bearing assembly 292. The working fluid, which in some embodiments is oil or water or the combination of oil and water, is used to lubricate the bearing assembly 298. The controlled leakage of working fluid from the seal assembly 298 ensures a continuous supply of clean working fluid to the bearings and also ensures that the release of pressure at the surface will enable the packers to deflate. Bearing assemblies, such as annular bearing assembly 292 and the associated rotary fluid seal assembly 298, are known in the art and are thus not further described herein.

An annular inflatable packer assembly 310 having a lower end portion 311 and an upper end portion 313 is integrally or otherwise fixedly attached to the housing lower sleeve portion 296. The packer assembly 310 includes an annular inner wall 312 that defines a portion of the fluid path 208. An annular outer packer wall 313, having an annular central opening 315-315 (i.e. the opening is positioned between axial locations 315 and 315), is positioned radially outwardly of the inner packer wall 312. The outer packer wall 313 has an expandable bladder 316 operably attached thereto. The bladder 316 may be expanded through opening 315-315 into engagement with the annular inner wall of the well casing 204 as shown in dashed lines. A rotary bearing seal assembly 320 is sealingly rotatable mounted on the drill pipe 246 at a position axially spaced from and above the lower rotary seal assembly 292. This rotary seal assembly 320 receives working fluid from the hollow driveshaft fluid passage 232 through radial bores 322 and transmits the working fluid to the inflatable bladder 316 via a radial conduit 324. The packer bladder 316 is thus in fluid communication with the fluid passage 232 and remains inflated so long as the working fluid remains pressurized. Reduction of the working fluid pressure allows the packer bladder 316 to deflate, enabling axial movement of the centrifugal pump 200 within the well casing 204.

The bowl assembly diffuser subassembly includes a first annular diffuser member 326 that is attached at a first end portion 328 thereof to the packer assembly 310 as by threading (not shown) or other attachment means. The first annular diffuser 326 has a generally concave shaped body portion 330, which ends in a threaded second end portion 332. A second annular diffuser member 340 having a first threaded end 342, a concave body portion 344 and a second threaded end portion 346 is threadingly attached to the first annular diffuser member 326. A third annular diffuser member 350 has a first threaded end portion 352 that is threadingly attached to the second threaded end portion 346 of the second annular diffuser member 340. The second annular diffuser member 340 has a free end that is radially spaced from an associated impeller member 384. A rotary bearing 358 is rotatably mounted on the third internal hollow drive shaft length 274 and may be held in fixed relationship with the diffuser subassembly as by struts 359. It may be seen from FIG. 3A that the connected first second and third annular diffuser members 326, 340 and 350, sometimes referred to as a diffuser subassembly, have a generally sinusoidal cross-section. An annular upper sleeve member 356 may be an axial extension of the second diffuser member 340. Sleeve member 356 defines an outlet of the bowl assembly 206.

As shown by FIG. 3A, a first annular impeller member 370 has a first end portion, terminating at 373, that is threaded onto an outer threaded portion of coupling 260. This threaded attachment holds the first impeller member 370 in coaxial, fixed relationship with the elongate hollow shaft assembly 230. Thus, the impeller member 370 rotates with the hollow shaft assembly 230. The impeller member 370, in one embodiment, is a mixed flow, open or semi open impeller member. The cross section of the first annular impeller member 370 has a generally convex shaped body portion 384 that generally conforms to the shape of the associated diffuser body portion. A second annular impeller member 380 has a first threaded annular end portion 382 threaded to coupling 270 that engages the second end portion 376 of the first impeller member 370 and also engages a circumferential portion of the internal hollow drive shaft length 254. The second impeller 380 has a convex body portion 384 and a second end portion 386 that engages an annular portion of drill pipe 274.

Figure 4:
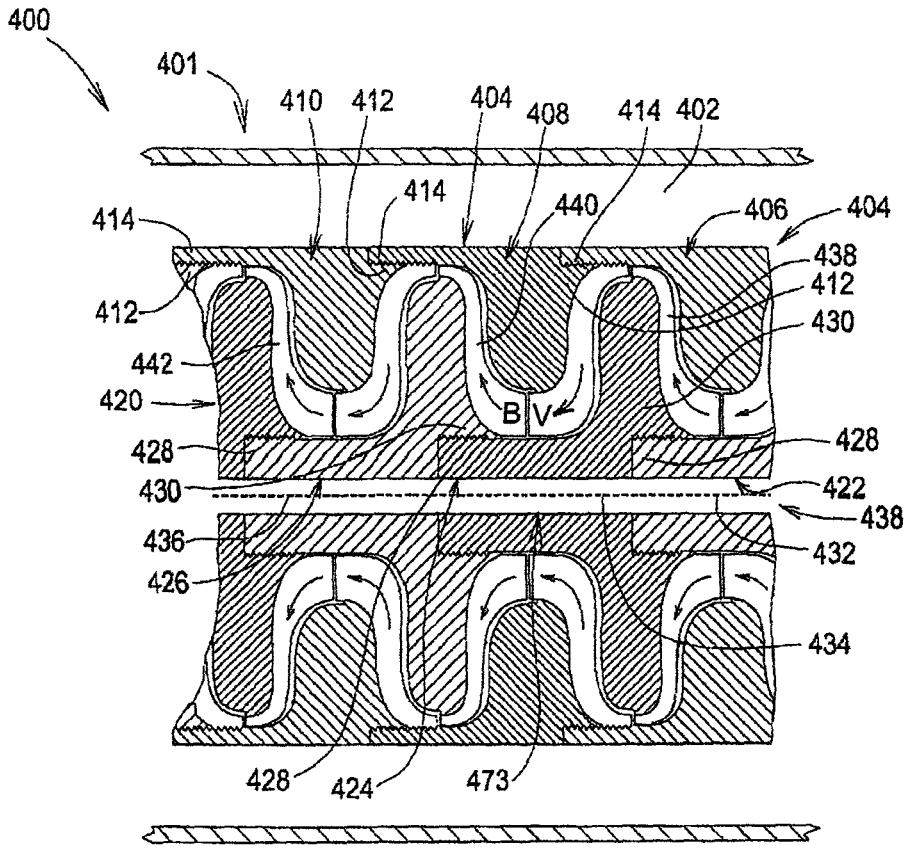
FIG. 4 is a schematic cross-sectional view of a portion of an example embodiment of another bowl assembly.

As shown in FIGS. 3A and 4, the first annular impeller member 370 includes the convex shaped body portion 384 and a plurality of impeller blades B projecting outwardly therefrom. Each impeller blade B has an axial length shorter than a length of it's associated convex shaped body portion 384. For example, the axial length of the blade can be about half the length of the convex shaped body portion 384. As also shown in FIGS. 3A and 4, the second annular diffuser member 340 includes a plurality of vanes V projecting inwardly from the concave body portion 344.

The attached first and second annular impeller members 370, 380, like the diffuser members 326, 340, 350, have an axially abutting configuration, and also have a generally sinusoidal cross-sectional shape. FIG. 4 is an axial cross-sectional view showing the relationship of an impeller member, e.g., impeller member 370, with an associated diffuser member, e.g. diffuser member 326. The annular impeller members 370, 380 and annular diffuser members 326, 340, 350 define a continuous axial passageway 354, which provides a portion of the fluid flow path through the bowl assembly 200.

As with the turbine-pump system described with reference to FIGS. 2A and 2B, the bowl assembly 200 may or may not be one of a series of identical bowl assemblies that are held within a conduit by a packer assembly 310 portion of the bowl assembly 200. The plurality of identical bowl assemblies 200 may each comprise a driveshaft assembly portion 230. These identical bowl assemblies 200 may each provide a turbine-pump system module. These modules may be connected to other modules that are connected by an upper module to a motor/generator 20, such as described with reference to FIGS. 2A and 2B. This modular construction facilitates the construction of a turbine-pump system because the modules can each be assembled at a warehouse facility and then transported to a well site and coupled together one at a time as each module is inserted into a well casing or other conduit. These modules are relatively light as compared to a pump column. Also, because each module supports its own weight within the well casing by means of its associated packer assembly there is virtually no limit to the well depth in which such a turbine-pump system may be deployed.

Another embodiment of a centrifugal pump 400 in which the impeller members themselves function as portions of a hollow drive shaft is illustrated in FIG. 4. A well casing 401 defines a cylindrical well cavity 402. A bowl assembly 404, positioned in the well cavity 402 comprises a diffuser subassembly that includes first, second and third diffuser members 406, 408, 410. Each diffuser member has a first threaded end portion 412 and a second threaded end portion 414.

An impeller subassembly 420 is operatively associated with the bowl assembly 404. The impeller subassembly 420 comprises first, second and third impeller members 422, 424, 426. Each impeller member has a first threaded end portion 428 and a second threaded end portion 430. In this embodiment the first and last impeller member in the impeller subassembly are each attached, at one end portion thereof, to an upper and lower hollow driveshaft portion, such as a drill pipe (not shown). However there are no intermediate drill pipes or coupling members connecting the impeller stages 422, 424, 426. Instead, the first threaded end portion 428 of each impeller member is connected to the second threaded end portions 430 of adjacent impeller member.

It may be seen from FIG. 4 that an internal cavity 432, 434, 436 of each annular impeller member 422, 424, 426 provides a portion of a continuous axial passageway 438, which is also formed in part by connected pipe members, such as oil well drill pipe (not shown). Thus, in this embodiment the impeller subassembly 422, 424, 426 and the connected drill pipes (not shown) are each portions of a hollow drive shaft assembly that rotates the impeller members and provides a working fluid passage for inflating an associated inflatable packer (not shown in FIG. 4) and for lubricating associated bearing assemblies (not shown in FIG. 4). In other words, the working fluid that in other embodiments is transmitted exclusively through internal passages in pipe and hollow couplings, is, in this embodiment transmitted through each impeller subassembly by the internal cavities in the impeller members. Similarly, the torque transmitted from or to a connected driver, e.g., driver 20 of FIG. 2A, to each impeller member, is now transmitted in each bowl assembly, exclusively by each impeller member to the adjacent impeller member with no intervening structure.

Although in the above described embodiments, impeller members and diffuser members are shown attached by threading, it will also be understood by those with skill in the art that such attachment could be made by other means, for example by interlocking slotted and keyed portions or various other attachment means known in the art. In some cases, such as in the use of threaded portions, this attachment will be readily detachable, in others, at least some of the attachments may be of a more permanent nature, such as welded or soldered attachments.

It will be appreciated from the above disclosure that a method of moving liquid through a well conduit may include providing at least one bowl assembly having an impeller subassembly and a diffuser subassembly. The method may also include nonrotatably supporting the diffuser subassembly at a desired axial position within the well conduit with a packer.

It will be also be appreciated from the above disclosure that a method of moving well liquid through a sell conduit may include fixedly mounting a plurality of bowl assemblies with impeller subassemblies therein in axially spaced apart relationship within the well conduit. The method may also include rotating all of the impeller subassemblies in the plurality of bowl assemblies with a single rotary driver.

Various embodiments of centrifugal turbine-pump systems and bowl assemblies thereof are expressly disclosed in detail herein. Alternative embodiments of such systems and assemblies will occur to those in the art after reading this disclosure. It is intended that the claims be construed broadly to cover such alternative embodiments, except as limited by the prior art.

What is claimed is:

1. A turbine-pump system for moving a liquid through a well having a well casing with an inner wall surface comprising:

a hollow driveshaft mounted for rotation in the well casing extending from a ground surface to a depth in the well;

a bowl assembly comprising:

an impeller subassembly comprising a plurality of impellers connected end to end on the hollow driveshaft and mounted for rotation in the well casing with the hollow driveshaft, each impeller comprising an impeller body and a plurality of blades projecting therefrom; and a diffuser subassembly comprising a plurality of diffusers connected end to end around the impellers configured to form a continuous axial passageway with the impellers and a flow path for the liquid, each diffuser comprising a stationary diffuser body opposing an associated impeller body and a plurality of vanes projecting therefrom;

an inflatable packer attached to the diffuser subassembly configured to allow placement of the bowl assembly at a desired location in the well casing and inflatable by transmission of a working fluid through the hollow driveshaft from the ground surface to engage the well casing to seal and support the bowl assembly and prevent rotation of the diffuser members, the inflatable packer, the impellers and the diffusers configured to pump the liquid through the continuous axial passageway and through the well casing on the inner wall surface of the well casing to the ground surface with the well casing providing a primary conduit for transmitting the liquid to the ground surface; and a second inflatable packer spaced from the inflatable packer and attached to the bowl assembly configured to seal and support the bowl assembly and channel the liquid into the well casing to the ground surface.

2. The turbine-pump system of claim 1 further comprising a rotary seal assembly around the hollow driveshaft configured to provide fluid communication between the hollow driveshaft and the inflatable packer.

3. A turbine-pump system for moving a liquid through a well having a well casing with an inner wall surface comprising:

a hollow driveshaft mounted for rotation in the well casing extending from a ground surface to a depth in the well;

a bowl assembly comprising:

an impeller subassembly comprising a plurality of impellers connected end to end on the hollow driveshaft and mounted for rotation in the well casing with the hollow driveshaft, each impeller comprising an impeller body and a plurality of blades projecting therefrom, with the impellers rotatable in a first direction for pumping the liquid from the well casing and in a second direction for injecting the liquid into the well casing;

a diffuser subassembly comprising a plurality of diffusers connected end to end around the impellers configured to form a continuous axial passageway with the impellers and a flow path for the liquid, each diffuser comprising a stationary diffuser body opposing an associated impeller body and a plurality of vanes projecting therefrom; and an inflatable packer attached to the diffuser subassembly configured to allow placement of the bowl assembly at a desired location in the well casing and inflatable by transmission of a working fluid through the hollow driveshaft from the ground surface to engage the well casing to seal and support the bowl assembly and prevent rotation of the diffuser members, the inflatable packer, the impellers and the diffusers configured to pump the liquid through the continuous axial passageway and through the well casing on the inner wall surface of the well casing to the ground surface with the well casing providing a primary conduit for transmitting the liquid to the ground surface.

4. A turbine-pump system for moving a liquid through a well having a well casing with an inner wall surface comprising:

a hollow driveshaft mounted for rotation in the well casing extending from a ground surface to a depth in the well;

a bowl assembly comprising:

an impeller subassembly comprising a plurality of impellers connected end to end on the hollow driveshaft and mounted for rotation in the well casing with the hollow driveshaft, each impeller comprising an impeller body and a plurality of blades projecting therefrom; and a diffuser subassembly comprising a plurality of diffusers connected end to end around the impellers configured to form a continuous axial passageway with the impellers and a flow path for the liquid, each diffuser comprising a stationary diffuser body opposing an associated impeller body and a plurality of vanes projecting therefrom;

an inflatable packer attached to the diffuser subassembly configured to allow placement of the bowl assembly at a desired location in the well casing and inflatable by transmission of a working fluid through the hollow driveshaft from the ground surface to engage the well casing to seal and support the bowl assembly and prevent rotation of the diffuser members, the inflatable packer, the impellers and the diffusers configured to pump the liquid through the continuous axial passageway and through the well casing on the inner wall surface of the well casing to the ground surface with the well casing providing a primary conduit for transmitting the liquid to the ground surface; and a plurality of bowl assemblies identical to the bowl assembly configured for mounting at different locations in the well casing.

5. The turbine-pump system of claim 4 wherein the diffusers have a generally sinusoidal shape along the continuous axial passageway and the impellers have a matching shape.

6. The turbine-pump system of claim 4 wherein each impeller blade has an axial length about one half a length of an associated impeller body.

7. A turbine-pump system for moving a liquid through a well having a well casing with an inner wall surface comprising:

a hollow driveshaft mounted for rotation in the well casing extending from a ground surface to a depth in the well;

a bearing assembly fixedly mounted to the well casing configured to support the hollow driveshaft for rotation;

a bowl assembly comprising:

an impeller subassembly comprising a plurality of impellers connected end to end on the hollow driveshaft and mounted for rotation in the well casing with the hollow driveshaft, each impeller comprising an impeller body and a plurality of blades projecting therefrom; and a diffuser subassembly comprising a plurality of diffusers connected end to end around the impellers configured to form a continuous axial passageway with the impellers and a flow path for the liquid, each diffuser comprising a stationary diffuser body opposing an associated impeller body and a plurality of vanes projecting therefrom; and an inflatable packer attached to the diffuser subassembly configured to allow placement of the bowl assembly at a desired location in the well casing and inflatable by transmission of a working fluid through the hollow driveshaft from the ground surface to engage the well casing to seal and support the bowl assembly and prevent rotation of the diffuser members, the inflatable packer, the impellers and the diffusers configured to pump the liquid through the continuous axial passageway and through the well casing on the inner wall surface of the well casing to the ground surface with the well casing providing a primary conduit for transmitting the liquid to the ground surface.

8. The turbine-pump system of claim 7 wherein the hollow driveshaft is configured to transmit the working fluid to the bearing assembly for lubricating the bearing assembly.

9. The turbine-pump system of claim 8 further comprising a second inflatable packer attached to the bearing assembly configured to support the bearing assembly in the well casing.

10. A turbine-pump system for moving a liquid through a well having a well casing with an inner wall surface comprising:

a hollow driveshaft mounted for rotation in the well casing extending from a ground surface to a depth in the well and having a fluid passage configured to supply a working fluid under pressure;

an inflatable packer mounted to the hollow driveshaft in fluid communication with the fluid passage configured for deflation and inflation by the working fluid to engage and seal the well casing;

a plurality of impellers attached end to end to the hollow driveshaft for rotation therewith and configured to transmit torque, each impeller comprising an impeller body rotatable with the hollow driveshaft and a plurality of blades projecting therefrom; and a plurality of diffusers around the impellers attached to the inflatable packer configured with the impellers to form a continuous axial passageway and a flow path for the liquid, each diffuser comprising a diffuser body opposing an associated impeller body and a plurality of vanes projecting therefrom;

the hollow driveshaft, the inflatable packer, the impellers and the diffusers configured to pump the liquid through the continuous axial passageway, and through the well casing on the inner wall surface of the well casing to the ground surface with the well casing providing a primary conduit for transmitting the liquid to the ground surface.

11. The turbine-pump system of claim 10 further comprising a rotary seal assembly around the hollow driveshaft configured to provide the fluid communication between the fluid passage and the inflatable packer.

12. The turbine-pump system of claim 10 further comprising a bearing assembly fixedly mounted to the well casing configured to support the hollow driveshaft for rotation and a second inflatable packer configured to support the bearing assembly.

13. A method of moving a liquid through a well having a well casing with an inner wall surface comprising:

providing a plurality of bowl assemblies, each bowl assembly comprising: a driveshaft subassembly comprising a hollow driveshaft mounted for rotation in the well casing and extending from a ground surface to a depth in the well, and a bearing assembly configured to support the hollow driveshaft for rotation, an impeller subassembly comprising a plurality of impellers attached to the hollow driveshaft having impeller bodies rotatable with the hollow driveshaft with blades thereon, a diffuser subassembly comprising a plurality of diffusers around the impellers having diffuser bodies with vanes configured to form a continuous axial passageway with the impellers and a flow path for the liquid, and an inflatable packer attached to the diffuser subassembly in flow communication with the hollow driveshaft;

placing a first bowl assembly at a first location in the well casing using the hollow driveshaft and a second bowl assembly at a second location in the well casing using the hollow driveshaft;

inflating the inflatable packer on the first bowl assembly and the inflatable packer on the second bowl assembly by transmitting a working fluid through the hollow driveshaft from the ground surface to seal and support the first bowl assembly at the first location in the well casing and to seal and support the second bowl assembly at the second location in the well casing; and moving the liquid through the well casing on the inner wall surface of the well casing to the ground surface by rotating the hollow driveshaft and the impellers with the well casing providing a primary conduit for transmitting the liquid to the ground surface;

wherein the hollow driveshaft comprises lengths of pipe and the placing step comprises attaching the lengths of pipe.

14. A method of moving a liquid through a well having a well casing with an inner wall surface comprising:

providing a plurality of bowl assemblies, each bowl assembly comprising: a driveshaft subassembly comprising a hollow driveshaft mounted for rotation in the well casing and extending from a ground surface to a depth in the well, and a bearing assembly configured to support the hollow driveshaft for rotation, an impeller subassembly comprising a plurality of impellers attached to the hollow driveshaft having impeller bodies rotatable with the hollow driveshaft with blades thereon, a diffuser subassembly comprising a plurality of diffusers around the impellers having diffuser bodies with vanes configured to form a continuous axial passageway with the impellers and a flow path for the liquid, and an inflatable packer attached to the diffuser subassembly in flow communication with the hollow driveshaft;

placing a first bowl assembly at a first location in the well casing using the hollow driveshaft and a second bowl assembly at a second location in the well casing using the hollow driveshaft;

inflating the inflatable packer on the first bowl assembly and the inflatable packer on the second bowl assembly by transmitting a working fluid through the hollow driveshaft from the ground surface to seal and support the first bowl assembly at the first location in the well casing and to seal and support the second bowl assembly at the second location in the well casing; and moving the liquid through the well casing on the inner wall surface of the well casing to the ground surface by rotating the hollow driveshaft and the impellers with the well casing providing a primary conduit for transmitting the liquid to the ground surface;

wherein the flow path through each bowl assembly is inside the inflatable packer, through the continuous axial passageway and into the well casing.

15. A method of moving a liquid through a well having a well casing with an inner wall surface comprising:

providing a plurality of bowl assemblies, each bowl assembly comprising: a driveshaft subassembly comprising a hollow driveshaft mounted for rotation in the well casing and extending from a ground surface to a depth in the well, and a bearing assembly configured to support the hollow driveshaft for rotation, an impeller subassembly comprising a plurality of impellers attached to the hollow driveshaft having impeller bodies rotatable with the hollow driveshaft with blades thereon, a diffuser subassembly comprising a plurality of diffusers around the impellers having diffuser bodies with vanes configured to form a continuous axial passageway with the impellers and a flow path for the liquid, and an inflatable packer attached to the diffuser subassembly in flow communication with the hollow driveshaft;

placing a first bowl assembly at a first location in the well casing using the hollow driveshaft and a second bowl assembly at a second location in the well casing using the hollow driveshaft;

inflating the inflatable packer on the first bowl assembly and the inflatable packer on the second bowl assembly by transmitting a working fluid through the hollow driveshaft from the ground surface to seal and support the first bowl assembly at the first location in the well casing and to seal and support the second bowl assembly at the second location in the well casing;

moving the liquid through the well casing on the inner wall surface of the well casing to the ground surface by rotating the hollow driveshaft and the impellers with the well casing providing a primary conduit for transmitting the liquid to the ground surface; and lubricating the bearing assembly by transmitting the working fluid through the hollow driveshaft to the bearing assembly.

16. The method of claim 15 wherein the moving step comprises rotating the hollow driveshaft and the impellers in a first direction to pump the liquid from the well casing.

17. The method of claim 15 wherein the moving step comprises rotating the hollow driveshaft and the impellers in a second direction to inject the liquid into the well casing.

* * * * *